US009722332B1

(12) United States Patent
Lin et al.

(10) Patent No.: US 9,722,332 B1
(45) Date of Patent: Aug. 1, 2017

(54) CONDUCTIVE BASE FOR ILLUMINATING BUILDING BLOCKS

(71) Applicant: LONGMEN GETMORE POLYURETHANE CO., LTD, Huizhou, Guangdong (CN)

(72) Inventors: Chia-Yen Lin, Huizhou (CN); Ya-Ping Feng, Hunan (CN)

(73) Assignee: LONGMEN GETMORE POLYURETHANE CO., LTD., Huizhou (CN)

( * ) Notice: Subject to any disclaimer, the term of this patent is extended or adjusted under 35 U.S.C. 154(b) by 0 days.

(21) Appl. No.: 15/396,414

(22) Filed: Dec. 30, 2016

(30) Foreign Application Priority Data

May 23, 2016 (CN) ..... 2016 2 0477669 U

(51) Int. Cl.

| | |
|---|---|
| ***H01R 12/58*** | (2011.01) |
| ***F21V 23/06*** | (2006.01) |
| ***H01R 13/42*** | (2006.01) |
| ***A63H 33/04*** | (2006.01) |
| ***A63H 33/08*** | (2006.01) |
| *H01R 13/24* | (2006.01) |

(52) U.S. Cl.
CPC ..... *H01R 12/58* (2013.01); *A63H 33/042* (2013.01); *A63H 33/08* (2013.01); *F21V 23/06* (2013.01); *H01R 13/42* (2013.01); *H01R 13/2428* (2013.01)

(58) Field of Classification Search
USPC ..... 439/700
See application file for complete search history.

(56) References Cited

U.S. PATENT DOCUMENTS

| | | | | |
|---|---|---|---|---|
| 5,807,123 | A * | 9/1998 | Spiegelaar | H01R 13/05 439/136 |
| 7,520,754 | B1 * | 4/2009 | Gattuso | G01R 1/0466 324/756.02 |
| 8,734,193 | B2 * | 5/2014 | Tokuhara | H01R 12/714 439/700 |
| 8,753,130 | B2 * | 6/2014 | Sato | H01R 13/2428 439/66 |
| 9,016,902 | B1 * | 4/2015 | Lin | F21S 2/005 362/249.01 |
| 9,457,287 | B1 * | 10/2016 | Lin | A63H 33/042 |
| 2006/0172613 | A1 * | 8/2006 | Sasaki | H01R 13/2421 439/824 |

* cited by examiner

*Primary Examiner* — Tho D Ta
(74) *Attorney, Agent, or Firm* — Pai Patent & Trademark Law Firm; Chao-Chang David Pai

(57) ABSTRACT

A conductive base for illuminating building blocks has a base plate, an anode conductive component, and a cathode conductive component. The base plate further has a plurality of hollow studs. The anode conductive component and the cathode conductive component electrically connect to an external power supply. The anode conductive component and the cathode conductive component are projected out of recesses of the hollow studs to contact circuit boards of illuminating building blocks stacked on the base plate and then build electric connections. The neighboring illuminating building blocks stacked on the base plate can emit light together by the above base plate without intricate circuits.

8 Claims, 9 Drawing Sheets

CONDUCTIVE BASE FOR ILLUMINATING BUILDING BLOCKS

BACKGROUND OF THE INVENTION

1. Field of the Invention

The present invention relates generally to a conductive base for illuminating building blocks, and in particular to a conductive base for illuminating building blocks having an anode electric connection member, a cathode electric connection member, and a plurality of electric connection conductive sheets. Light is emitted from an illuminating building block mounted on the conductive base for illuminating the building block through the electric connection among the anode electric connection member, the cathode electric connection member, the electric connection conductive sheets, and the conductive base.

2. Description of the Related Art

A conventional illuminating building block disclosed in Taiwan Patent No. TW I500441 discloses a variable lighting structure which can be built by stacking conventional illuminating building blocks. The stacked conventional illuminating building blocks are electrically connected with an external power supply only by the lowest level conventional illuminating building block. The upper level conventional illuminating building blocks stacked on the lowest level conventional illuminating building block directly or indirectly emit light together with the lowest level conventional illuminating building block. However, the other conventional illuminating building blocks mounted beside the lowest level conventional illuminating building block cannot emit light together with the lowest level conventional illuminating building block. It is a severe restriction on playing the conventional illuminating building blocks.

SUMMARY OF THE INVENTION

A primary objective of the present invention is to provide a large base plate to illuminate all illuminating building blocks stacked on the large base plate.

The main objective of the present invention is to provide a conductive base for illuminating building blocks, comprising:

a base plate including a top surface, at least one side wall and an accommodating space defined by the top surface and the at least one side wall, the base plate further comprising: a plurality of hollow studs, a plurality of slots, an anode conductive component and a cathode conductive component;

the hollow studs projected from the top surface away from the accommodating space, each hollow stud comprising a top portion protruding away from the accommodating space, the top portion including two recesses defined therethrough and connected to the accommodating space;

the slots formed in the accommodating space and corresponding to the recesses of the hollow studs;

the anode conductive component inserted into one of the slots, an end of the anode conductive component protruding from one of the two recesses of each of the hollow studs, the anode conductive component including an anode electric connection sheet and at least two anode conductive sheets, the anode electric connection sheet electrically connected with the at least two anode conductive sheets and engaged with the base plate in the accommodating space; and the cathode conductive component inserted into another one of the slots next to the anode conductive component, an end of the cathode conductive component protruding from the other one of the two recesses of each of the hollow studs, the cathode conductive component including a cathode electric connection sheet and at least two cathode conductive sheets, the cathode electric connection sheet electrically connected with the at least two cathode conductive sheets and engaged with the base plate in the accommodating space.

The conductive base for illuminating building blocks according to the present invention utilizes the anode conductive component and the cathode conductive component to form an electric connection between an external power supply and illuminating building blocks stacked on the base plate.

Preferably, a conductive area and a non-conductive area are formed by arrangements of the hollow studs on the top surface of the base plate. The conductive base for illuminating building blocks according to the present invention utilizes different arrangements of the hollow studs on the base plate to form a conductive area with the hollow studs and a non-conductive area without the hollow studs. It enhances the variety of the base plate with the conductive base for illuminating building blocks.

More preferably, each one of the at least two anode conductive sheets includes a connection sheet and at least one electric connection projection sheet. The at least one electric connection projection sheet corresponds to the recesses of the hollow studs and passes through the accommodating space and then protrudes out of the recesses of the hollow studs. Each one of the at least two cathode conductive sheets also includes a connection sheet and at least one electric connection projection sheet. The at least one electric connection projection sheet corresponds to the recesses of the hollow studs and passes through the accommodating space and then protrudes out of the recesses of the hollow studs. The conductive base for illuminating building blocks according to the present invention utilizes the anode electric connection sheet to electrically connect with all the anode conductive sheets and the cathode electric connection sheet to electrically connect with all the cathode conductive sheets. Every electric connection projection sheet protruded out of the recesses of the hollow studs can electrically connect with an external power supply. Power from the external power supply is transmitted to and illuminates all the illuminating building blocks stacked on the base plate through the above electric connection projection sheets.

And more preferably, each one of the at least one electric connection projection sheet of the anode conductive sheet includes a connection end and a projection end. The connection end connects to the connection sheet, and the projection end extends out of the recesses to form an elastic structure between the connection end and the projection end by bending and folding. Each one of the at least one electric connection projection sheet of the cathode conductive sheet includes a connection end and a projection end. The connection end connects to the connection sheet and the projection end extends out of the recesses to form another elastic structure between the connection end and the projection end by bending and folding. The conductive base for illuminating building blocks according to the present invention utilizes the projection end of the electric connection projection that protrudes out of the recesses to directly contact the circuit board of the illuminating building blocks stacked on the base plate and the anode conductive component or the cathode conductive component. The structure of each electric connection projection sheet has elasticity by bending and folding between the connection end and the projection end, such that the projection end of the electric connection projection sheet is pressed against the circuit board of the illuminating building blocks stacked on the base plate stably, ensuring the effective contact between an external power supply and the illuminating building blocks stacked on the base plate.

Most preferably, the anode conductive sheet includes at least one first engaging piece. The anode electric connection sheet includes at least one second engaging piece. The base plate includes at least one first engaging indentation and at least one second engaging indentation in the accommodating space. The at least one first engaging piece engages with the first engaging indentation, and the at least one second engaging piece engages with the second engaging indentation. The cathode conductive sheet also includes at least one first engaging piece. The cathode electric connection sheet includes at least one second engaging piece. The base plate includes at least one first engaging indentation and at least one second engaging indentation in the accommodating space. The at least one first engaging piece engages with the first engaging indentation, and the at least one second engaging piece engages with the second engaging indentation. The conductive base for illuminating building blocks according to the present invention utilizes the first engaging piece of each anode conductive sheet and each cathode conductive sheet corresponds to the first engaging indentation of the base plate in the accommodating space to fix the anode conductive sheet, the cathode conductive sheet and the base plate. The anode conductive sheet and the cathode conductive sheet cannot easily separate from the base plate by pressure from the illuminating building blocks stacked on the base plate. Moreover, the conductive base for illuminating building blocks according to the present invention also utilizes the second engaging piece of the anode electric connection sheet and the cathode electric connection sheet corresponding to the second engaging indentation of the base plate in the accommodating space to fix the anode electric connection sheet, the cathode electric connection sheet and the base plate. The anode electric connection sheet and the cathode electric connection sheet cannot easily separate from the base plate by pressure from the illuminating building blocks stacked on the base plate. The engaging piece and the engaging indentation help the anode conductive component, the cathode conductive component and the base plate to be combined and fixed firmly, preventing influencing the power transmission by separation of the above members.

DETAILED DESCRIPTION OF THE INVENTION

Figure 1:
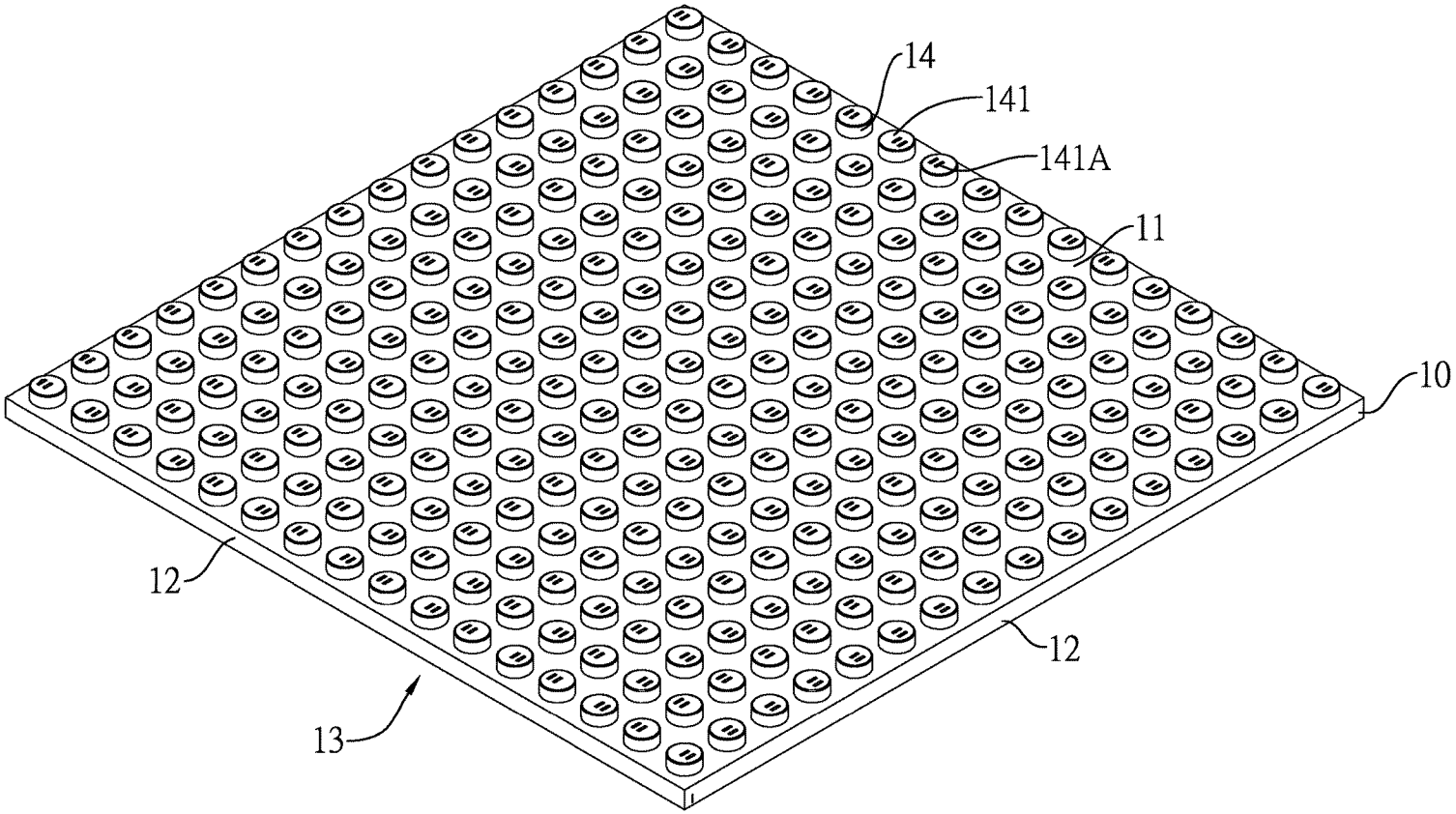
FIG. 1 is a perspective view showing a conductive base for illuminating building blocks according to a first preferred embodiment of the present invention.
Figure 2:
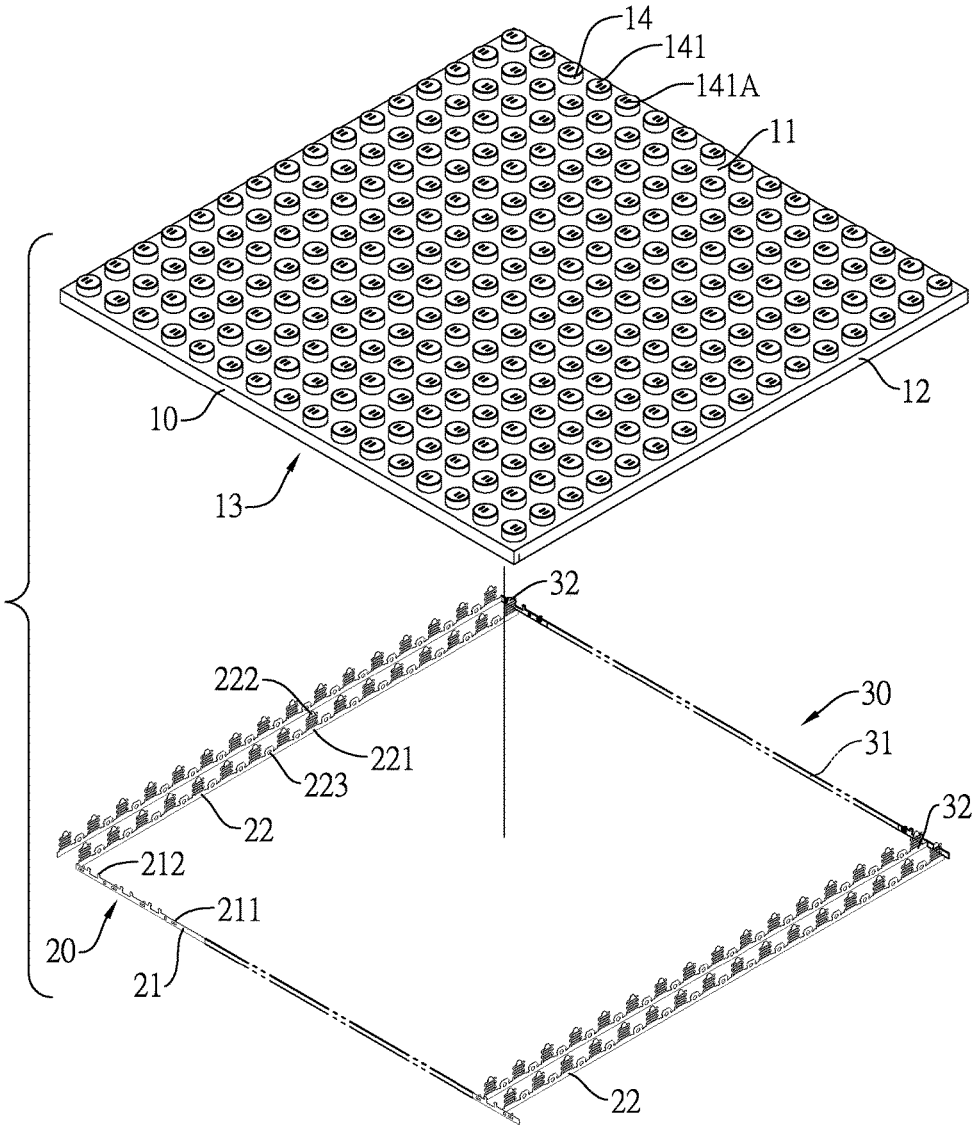
FIG. 2 is an exploded view showing the conductive base for illuminating building blocks according to the first preferred embodiment of the present invention.
Figure 3:
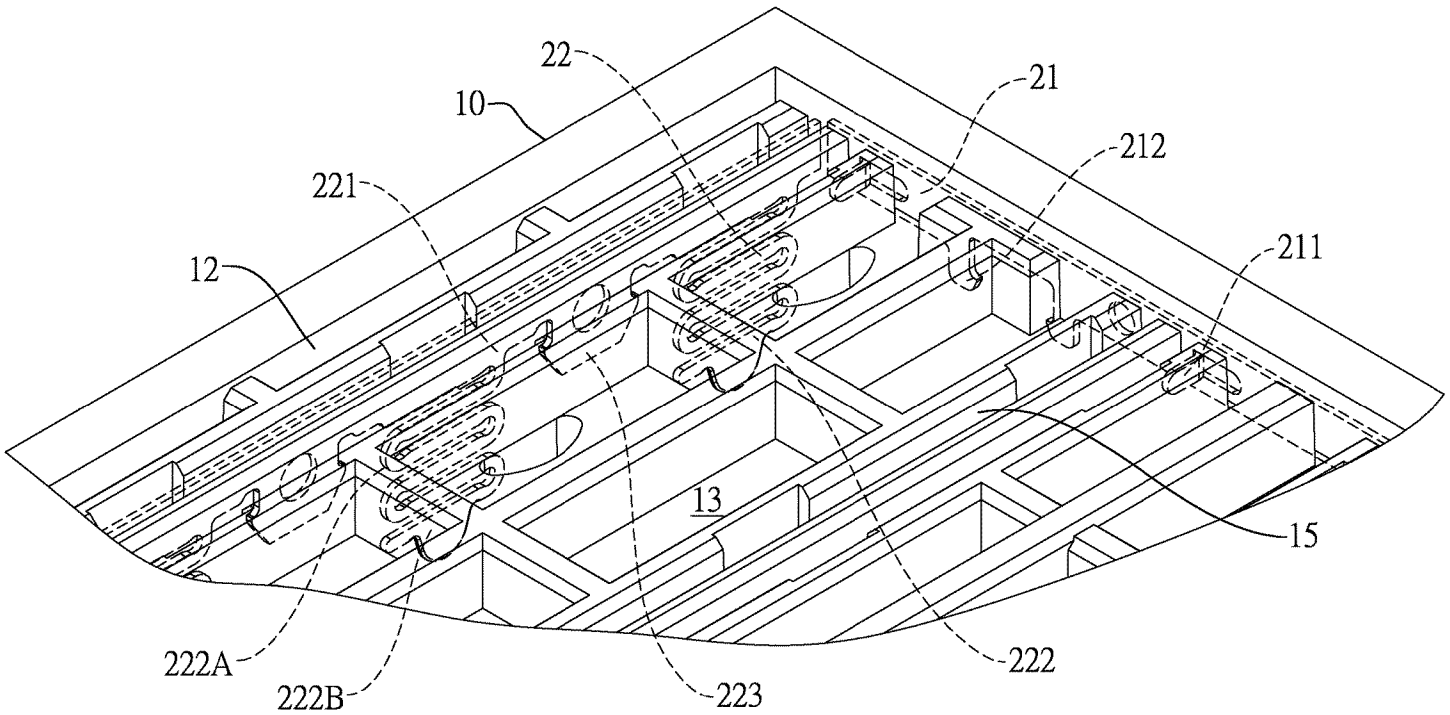
FIG. 3 is a detailed view showing an accommodating space of the conductive base for illuminating building blocks according to a first preferred embodiment of the present invention.

With reference to FIGS. 1 to 3, a conductive base for illuminating building blocks according to a first preferred embodiment of the present invention includes a base plate 10, an anode conductive component 20 and a cathode conductive component 30.

The base plate 10 has a rectangular plate structure and includes a top surface 11 and four side walls 12. An accommodating space 13 is formed and surrounded by the top surface 11 and the four side walls 12 and has an opening toward the bottom of the base plate 10.

The base plate 10 further includes two hundred fifty-six hollow studs 14 and thirty-two slots 15. The two hundred fifty-six hollow studs 14 are arranged as 16×16 arrays. The thirty-two slots 15 are arranged in parallel. The hollow studs 14 are projected from the top surface 11 away from the accommodating space 13. A top portion 141 of each hollow stud 14 is formed away from the accommodating space 13 and includes two recesses 141A defined therethrough. The two recesses 141A are rectangles and parallel with each other. The slots 15 are formed in the accommodating space 13. The extension direction of the slots 15 is parallel with the extension direction of the recesses 141A. The slots 15 correspond to the recesses 141A such that the outer space out of the bottom of the base plate 10 connects to the outer space out of the top of the base plate 10 via the slots 15, the interior space of the hollow studs 14 and the recesses 141A.

The anode conductive component 20 includes an anode electric connection sheet 21 and anode conductive sheets 22. From FIG. 2, the largest amount of the anode conductive sheets 22 is sixteen, which is equal to the amount of lines of the hollow studs 14 on the base plate 10. The anode electric connection sheet 21 is used to connect the anode conductive sheets 22 and an external power supply (not shown in figures). Power from the external power supply is transmitted to each one of the anode conductive sheets 22 through the anode electric connection sheet 21.

Figure 4:
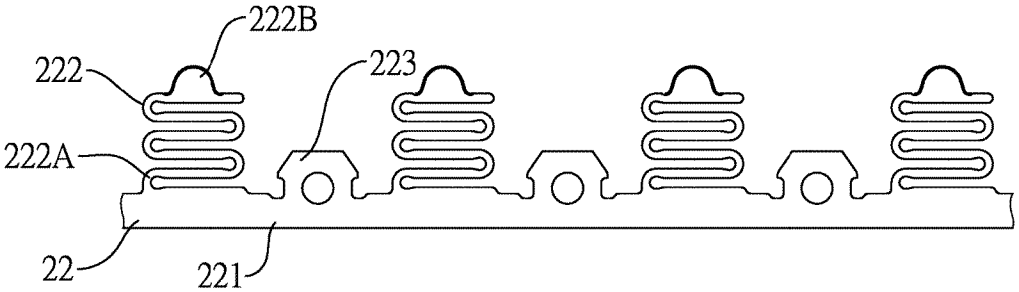
FIG. 4 is a detailed view showing an anode conductive sheet of the conductive base for illuminating building blocks according to the present invention.
Figure 5:
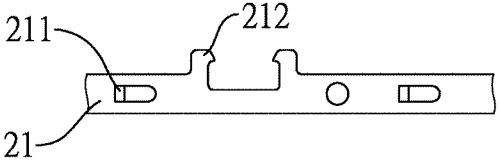
FIG. 5 is a detailed view showing an anode electric connection sheet of the conductive base for illuminating building blocks according to the present invention.

Referring to FIGS. 4 and 5, each one of the anode conductive sheets 22 includes a connection sheet 221, a plurality of electric connection projection sheets 222 and a plurality of first engaging pieces 223. The connection sheet 221 has a rectangular plate structure as shown in FIGS. 2, 4, 5, 6 and 7. The electric connection projection sheets 222 are projected from the top of the connection sheet 221. A largest amount of the electric connection projection sheets 222 is sixteen, which is equal to the amount of each column of the hollow studs 14 on the base plate 10. The first engaging pieces 223 are also projected from the top of the connection sheet 221. A largest amount of the first engaging pieces 223 is fifteen. The location of each first engaging piece 223 corresponds to a location between two hollow studs 14 on the base plate 10.

The above electric connection projection sheet 222 includes a connection end 222A and a projection end 222B. The connection end 222A connects to the projection end 222B, and the projection end 222B is projected from the connection end 222A. An elastic structure is formed between the connection end 222A and the projection end 222B by bending and folding. When the projection end 222B is pressed by an external force, the projection end 222B can be compressed toward the connection end 222A. When the external force is released, the projection end 222B can restore back to the initial position away from the connection end 222A.

Figure 6:
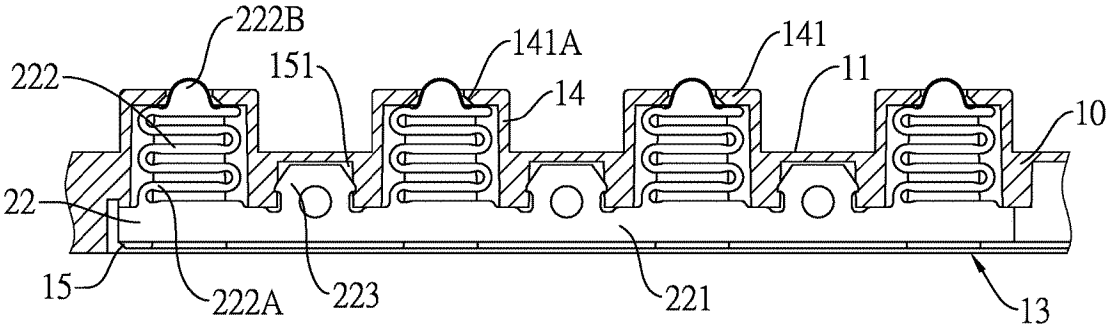
FIG. 6 is a cross sectional view showing the engagement between the anode conductive sheet and the base plate of the conductive base for illuminating building blocks according to the present invention.
Figure 7:
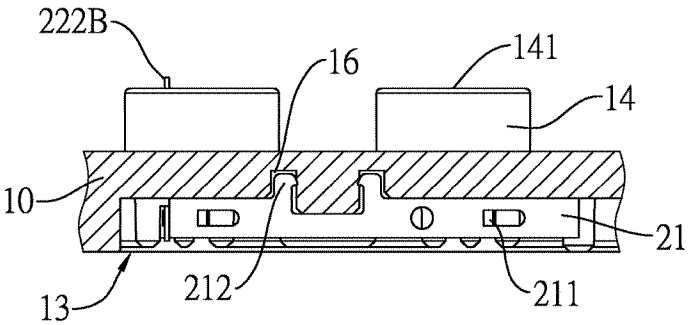
FIG. 7 is a cross sectional view showing the engagement between the anode electric connection sheet and the base plate of the conductive base for illuminating building blocks according to the present invention.

Referring to FIGS. 2, 4 and 6, each one of the slots 15 of the base plate 10 includes a plurality of first engaging indentations 151 in the accommodating space 13. Each first engaging indentation 151 corresponds to the first engaging piece 223 of the anode conductive sheet 22 in position and shape. The first engaging piece 223 is engaged with the first engaging indentation 151 when the anode conductive sheet 22 is inserted into the slot 15 of the base plate 10. The projection ends 222B of the electric connection projection sheets 222 on the anode conductive sheets 22 can extend out of the recesses 141A of the hollow studs 14 to contact and electrically connect with an illuminating building block stacked on the base plate 10.

Referring to FIGS. 2, 3, 5 and 7, the anode electric connection sheet 21 has a rectangular plate structure and includes a plurality of contacting sheets 211 and a plurality of second engaging pieces 212. The contacting sheets 211 and the second engaging pieces 212 extend out of the anode electric connection sheet 21. The extension direction of the contacting sheets 211 is perpendicular to the extension direction of the second engaging pieces 212. The contacting sheets 211 can contact and electrically connect with the anode conductive sheets 22 inserted into the slot 15. The second engaging pieces 212 can be engaged with the base plate 10 in the accommodating space 13. A largest amount of the contacting sheets 211 is sixteen as shown in FIG. 2, and the amount of the contacting sheets 211 is equal to the largest amount of the anode conductive sheets 22 inserted in the base plate 10.

The base plate 10 includes second engaging indentations 16 in the accommodating space 13. Each second engaging indentation 16 corresponds to the second engaging piece 212 of the anode electric connection sheet 21 in position and shape. When the anode electric connection sheet 21 is inserted into the base plate 10, the second engaging piece 212 is engaged with the second engaging indentation 16 to make the contacting sheets 211 of the anode electric connection sheet 21 stably contact and electrically connect with the anode conductive sheets 22 inserted into the slot 15. Therefore, power from the external power supply is transmitted to each anode conductive sheets 22 through the anode electric connection sheet 21.

Referring to FIG. 2, the cathode conductive component 30 includes a cathode electric connection sheet 31 and a plurality of cathode conductive sheets 32. The structures of the cathode electric connection sheet 31 are identical to the structures of the anode electric connection sheet 21, and the structures of the cathode conductive sheets 32 are also identical to the structures of the anode conductive sheets 22. The electrically connecting module between the cathode conductive sheet 32 and the cathode electric connection sheet 31 are identical to the anode electric connection sheet 21 and the anode conductive sheets 22. The engaging module between the cathode electric connection sheet 31 and the base plate 10, and between the cathode conductive sheet 32 and the base plate 10 are identical to the anode electric connection sheet 21 and the anode conductive sheets 22. Furthermore, the cathode conductive component 30 is alternately arranged with the anode conductive component 20 at spaced intervals.

Referring to FIG. 2, the anode electric connection sheet 21 and the cathode electric connection sheet 31 are mounted on the opposite sides of the base plate 10 in the accommodating space 13. The anode electric connection sheet 21 is mounted near the side walls 12 of the left side with the base plate 10. The cathode electric connection sheet 31 is mounted near the side walls 12 of the right side with the base plate 10. The anode conductive sheets 22 electrically connecting to the anode electric connection sheet 21 and the cathode conductive sheet 32 electrically connecting to the cathode electric connection sheet 31 are arranged interdigitatedly. Specifically, a cathode conductive sheet 32 is mounted between the two anode conductive sheets 22 and an anode conductive sheet 22 is mounted between the two cathode conductive sheets 32. The anode conductive sheets 22 and the cathode conductive sheet 32 do not contact each other. That is, the anode electric connection sheet 21 only contacts the anode conductive sheets 22 and the cathode electric connection sheet 31 only contacts the cathode conductive sheet 32. The neighboring anode conductive sheets 22 and cathode conductive sheet 32 can correspond to the two recesses 141A of one hollow stud 14. The electric connection projection sheets 222 of the anode conductive sheets 22 and the electric connection projection sheets of the cathode conductive sheets 32 are projected out of the two recesses 141A of the one hollow stud 14 to make the electric connection projection sheets 222 of the anode conductive sheets 22 and the electric connection projection sheets of the cathode conductive sheets 32 contact and electrically connect with an illuminating building block stacked on the base plate 10. Power from the external power supply is transmitted to the illuminating building block stacked on the base plate 10 through the electric connection to illuminate all the illuminating building block stacked on the base plate 10 successfully.

Figure 8:
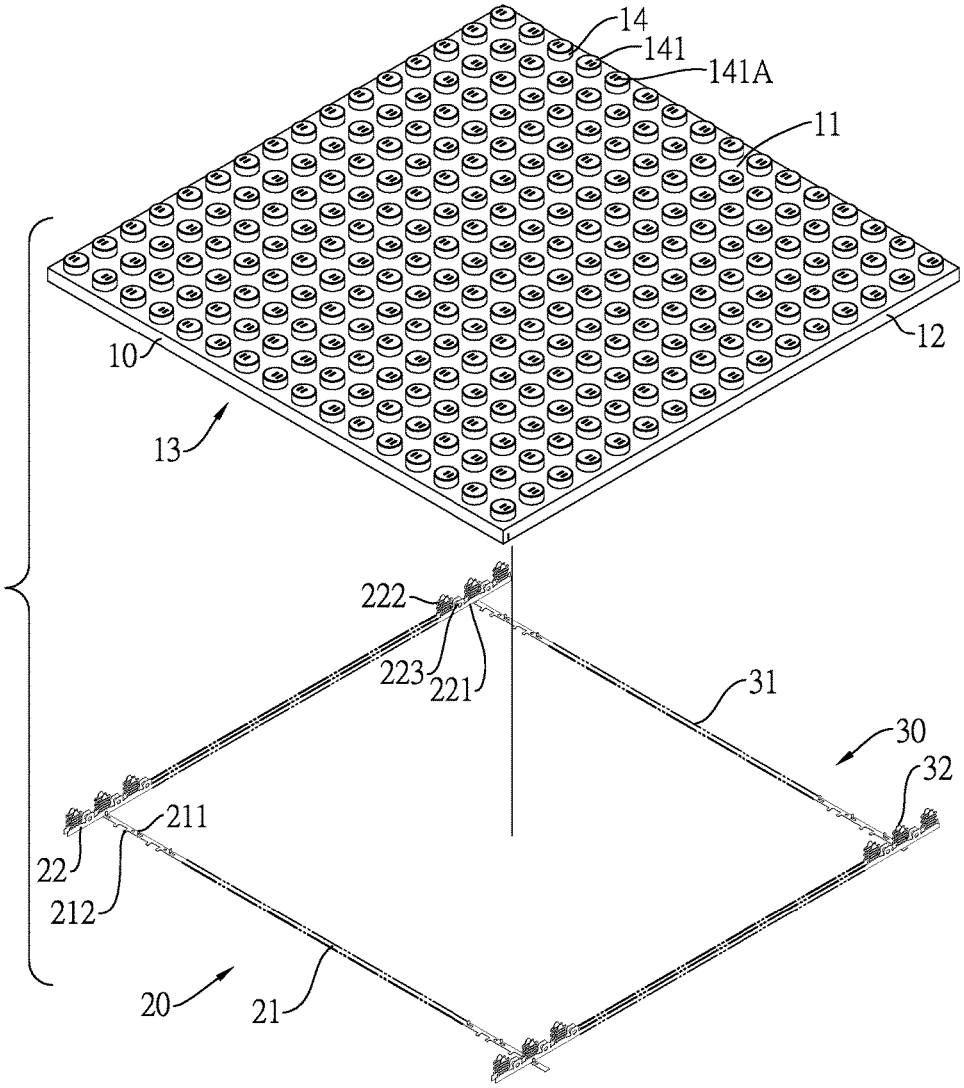
FIG. 8 is an exploded view showing the conductive base for illuminating building blocks according to a second preferred embodiment of the present invention.

Referring to FIG. 8, a second preferred embodiment of the present invention is that the anode electric connection sheet 21 and the cathode electric connection sheet 31 are not restricted to be mounted near the side walls 12 of the base plate 10. The anode electric connection sheet 21 and the cathode electric connection sheet 31 can be mounted away from edges of the base plate 10 within the accommodating space 13. Compared to the first embodiment, the anode electric connection sheet 21 and the cathode electric connection sheet 31 need to rotate a right angle in the second preferred embodiment to make the contacting sheets 211 of the anode electric connection sheet 21 and the contacting sheets of the cathode electric connection sheet 31 projected toward the base plate 10. Then the contacting sheets 211 of the anode electric connection sheet 21 can contact and electrically connect with the anode conductive sheets 22, and the contacting sheets of the cathode electric connection sheet 31 can contact and electrically connect with the cathode conductive sheet 32. A plurality of notches are formed on the base plate 10 within the accommodating space 13, and the notches can be engaged with the second engaging pieces 212 of the anode electric connection sheet 21 and the second engaging pieces of the cathode electric connection sheet 31. The anode electric connection sheet 21 and the cathode electric connection sheet 31 can be mounted away from the edges of the base plate 10 within the accommodating space 13 by the above structures to construct an electric connection between an external power supply and the illuminating building blocks stacked on the base plate 10.

Figure 9:
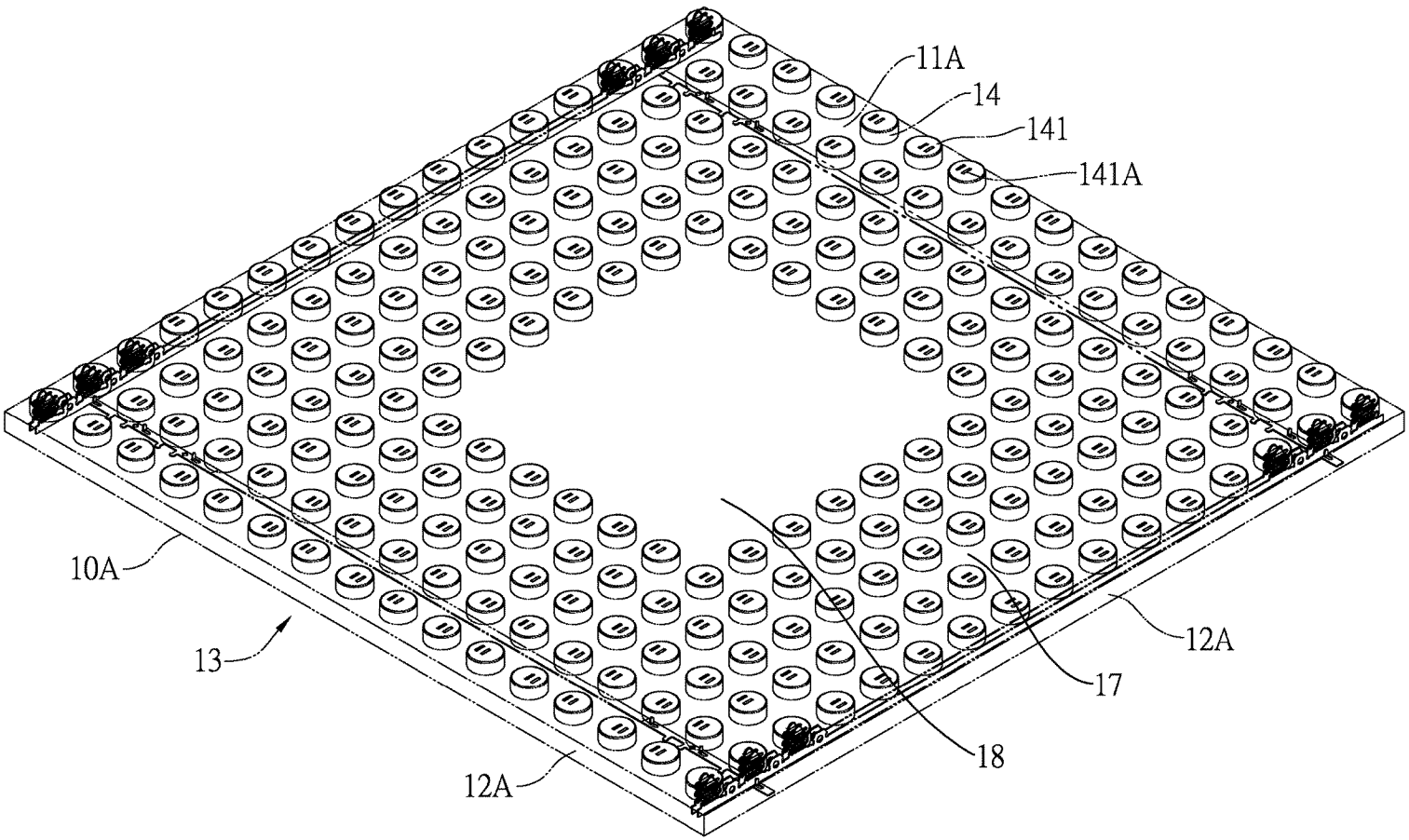
FIG. 9 is a perspective view showing a conductive base for illuminating building blocks according to a third preferred embodiment of the present invention.

Referring to FIG. 9, a third preferred embodiment of the present invention is that a conductive area 17 and a non-conductive area 18 are formed on the top surface 11A of the base plate 10A by different arrangements of the hollow studs 14. The amount of the electric connection projection sheets 222 on the anode conductive sheets 22 or on the cathode conductive sheet 32 corresponds to the amount of the hollow studs 14 arranged on each line or column of the top surface 11A of the base plate 10A. The conductive base for illuminating building blocks becomes more versatile without influencing the electric connection between the external power supply and the illuminating building blocks stacked on the base plate 10A.

Figure 10:
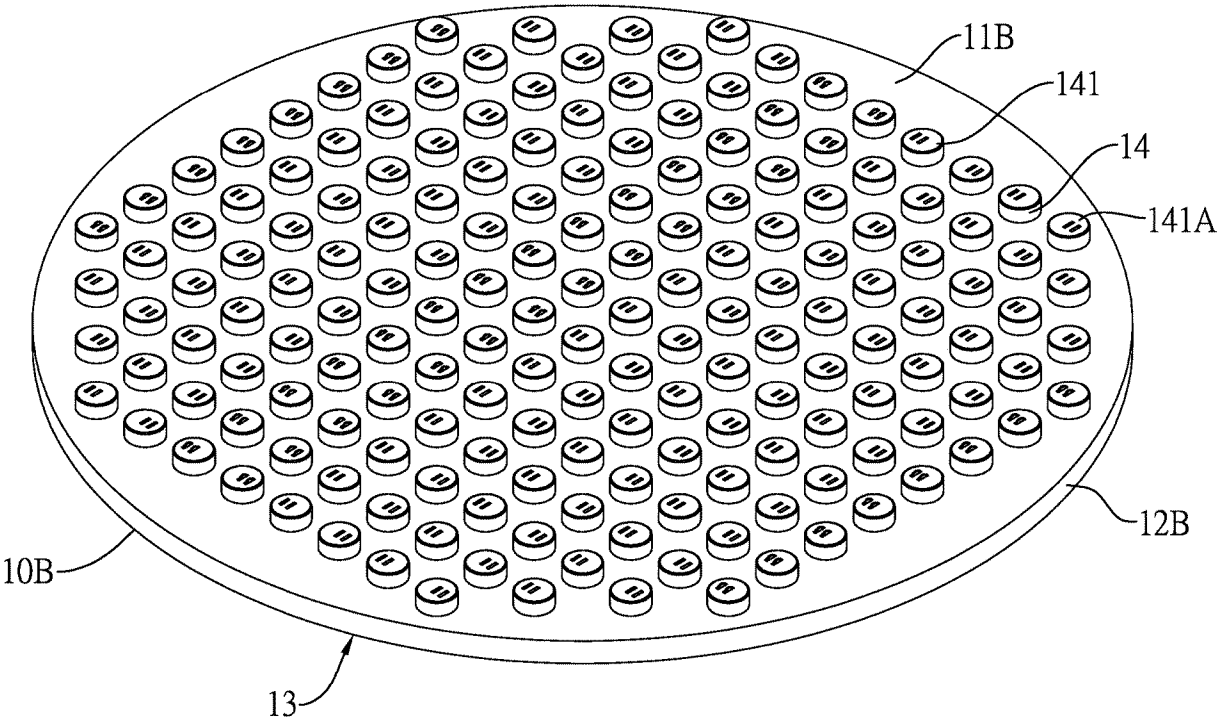
FIG. 10 is a perspective view showing a conductive base for illuminating building blocks according to a fourth preferred embodiment of the present invention.
Figure 11:
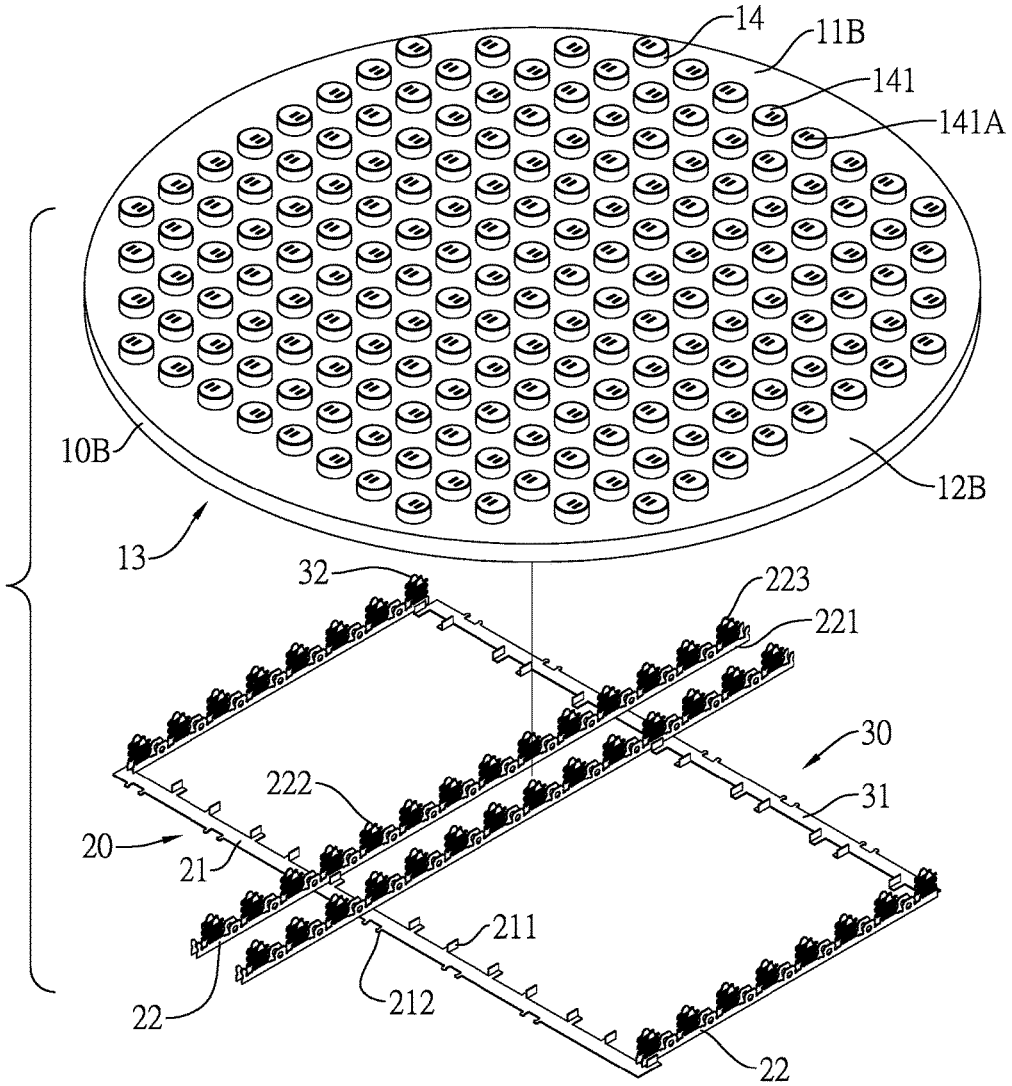
FIG. 11 is an exploded view showing the conductive base for illuminating building blocks according to the fourth preferred embodiment of the present invention.

Referring to FIGS. 10 and 11, a fourth preferred embodiment of the present invention is that a base plate 10B of the conductive base for illuminating building blocks has a circular plate structure. The base plate 10B includes a top surface 11B and a side wall 12B. The amount of the electric connection projection sheets 222 on the anode conductive sheets 22 or on the cathode conductive sheet 32 corresponds to the amount of the hollow studs 14 arranged on each line or column of the top surface 11B of the base plate 10B. Power from an external power supply also can be transmitted to the illuminating building blocks stacked on the base plate 10B. In summary, the conductive base for illuminating building blocks of the present invention utilizes the hollow studs 14 of the base plate 10, 10A, 10B and the recesses 141A of the hollow studs 14 to provide that the anode conductive sheets 22 and the cathode conductive sheet 32 inserted into the base plate 10, 10A, 10B can be projected out of the recesses 141A. The illuminating building blocks stacked on the base plate 10, 10A, 10B are electrically connected with the anode conductive sheets 22 and the cathode conductive sheet 32. Power from the external power supply is transmitted to the illuminating building blocks stacked on the base plate 10, 10A, 10B through the anode conductive component 20 and the cathode conductive component 30 to illuminate all the illuminating building blocks stacked on the base plate 10, 10A, 10B together even each two illuminating building blocks are left and right adjacent. Thus much more variety of lighting structures can be built on the larger conductive base, rather than limited by previous conventional illumination building blocks.

What is claimed is:

1. A conductive base for illuminating building blocks, comprising:

a base plate including a top surface, at least one side wall and an accommodating space defined by the top surface and the at least one side wall, the base plate further comprising: a plurality of hollow studs, a plurality of slots, an anode conductive component and a cathode conductive component;

the hollow studs projected from the top surface away from the accommodating space, each hollow stud comprising a top portion protruding away from the accommodating space, and the top portion including two recesses defined therethrough and connected to the accommodating space;

the slots formed in the accommodating space and corresponding to the recesses of the hollow studs;

the anode conductive component inserted into one of the slots, an end of the anode conductive component protruding from one of the two recesses of each of the hollow studs, the anode conductive component including an anode electric connection sheet and at least two anode conductive sheets, the anode electric connection sheet electrically connected with the at least two anode conductive sheets and engaged with the base plate in the accommodating space; and the cathode conductive component inserted into another one of the slots next to the anode conductive component, an end of the cathode conductive component protruding from the other one of the two recesses of each of the hollow studs, the cathode conductive component including a cathode electric connection sheet and at least two cathode conductive sheets, the cathode electric connection sheet electrically connected with the at least two cathode conductive sheets and engaged with the base plate in the accommodating space.

2. The conductive base for illuminating building blocks as claimed in claim 1, wherein a conductive area and a non-conductive area are formed by arrangements of the hollow studs on the top surface of the base plate.

3. The conductive base for illuminating building blocks as claimed in claim 1, wherein each one of the at least two anode conductive sheets includes a connection sheet and at least one electric connection projection sheet, and the at least one electric connection projection sheet corresponds to the recesses of the hollow studs and passes through the accommodating space and then protrudes out of the recesses of the hollow studs.

4. The conductive base for illuminating building block as claimed in claim 1, wherein each one of the at least two cathode conductive sheets includes a connection sheet and at least one electric connection projection sheet, and the at least one electric connection projection sheet corresponds to the recesses of the hollow studs and passes through the accommodating space and then protrudes out of the recesses of the hollow studs.

5. The conductive base for illuminating building blocks as claimed in claim 3, wherein each of the at least one electric connection projection sheet of the anode conductive sheet includes a connection end and a projection end, the connection end connects to the connection sheet, the projection end extends out of the recesses, and an elastic structure is formed between the connection end and the projection end by bending and folding.

6. The conductive base for illuminating building blocks as claimed in claim 4, wherein each one of the at least one electric connection projection sheet of the cathode conductive sheet includes a connection end and a projection end, the connection end connects to the connection sheet, the projection end extends out of the recesses, and an elastic structure is formed between the connection end and the projection end by bending and folding.

7. The conductive base for illuminating building blocks as claimed in claim 5, wherein the anode conductive sheet includes at least one first engaging piece, the anode electric connection sheet includes at least one second engaging piece, the base plate includes at least one first engaging indentation and at least one second engaging indentation in the accommodating space, the at least one first engaging piece engages with the first engaging indentation, and the at least one second engaging piece engages with the second engaging indentation.

8. The conductive base for illuminating building blocks as claimed in claim 6, wherein the cathode conductive sheet includes at least one first engaging piece, the cathode electric connection sheet includes at least one second engaging piece, the base plate includes at least one first engaging indentation and at least one second engaging indentation in the accommodating space, the at least one first engaging piece engages with the first engaging indentation, and the at least one second engaging piece engages with the second engaging indentation.

* * * * *